US009902595B2

(12) United States Patent
Lampinen et al.

(10) Patent No.: US 9,902,595 B2
(45) Date of Patent: Feb. 27, 2018

(54) ELEVATOR

(71) Applicant: KONE Corporation, Helsinki (FI)

(72) Inventors: Riku Lampinen, Helsinki (FI); Hannu Lehtinen, Numminen (FI); Pekka Leppäaho, Hyvinkää (FI); Antti Ikonen, Joensuu (FI); Jarmo Reijonen, Hyvinkää (FI); Lasse Nyman, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 418 days.

(21) Appl. No.: 14/602,043

(22) Filed: Jan. 21, 2015

(65) Prior Publication Data

US 2015/0232302 A1 Aug. 20, 2015

(30) Foreign Application Priority Data

Feb. 19, 2014 (EP) ..... 14155771

(51) Int. Cl.
*B66B 7/08* (2006.01)
*B66B 9/00* (2006.01)

(52) U.S. Cl.
CPC ..... *B66B 7/08* (2013.01); *B66B 9/00* (2013.01)

(58) Field of Classification Search
CPC ..... B66B 7/08; B66B 7/085; B66B 7/062; B66B 7/06; B66B 7/10; B66B 11/0065
See application file for complete search history.

(56) References Cited

U.S. PATENT DOCUMENTS 1,696,889 A * 12/1928 Scott ..... B66B 7/08 24/114.5
2,227,528 A * 1/1941 Adler ..... F16L 3/2235 174/1
3,453,900 A * 7/1969 Orndorff, Jr. ..... F16G 1/08 474/148
3,991,856 A * 11/1976 Shigeta ..... B66B 7/06 174/42

(Continued)

FOREIGN PATENT DOCUMENTS

EP 1 710 194 A2 10/2006
FR 1.178.528 5/1959

(Continued)

*Primary Examiner* — William E Dondero
*Assistant Examiner* — Diem M Tran
(74) *Attorney, Agent, or Firm* — Birch, Stewart, Kolasch & Birch, LLP

(57) ABSTRACT

A rope clamp for clamping one or more ropes includes a first clamping member having a first clamping face for being set against one or more ropes to be clamped and a second clamping member having a second clamping face for being set against one or more ropes to be clamped. The clamping faces defining a gap (between them) for receiving one or more ropes. The clamping members are relatively movable towards each other such that the gap is narrowed. The first clamping member and/or the second clamping member includes a metallic face part forming the clamping face of the clamping member, a metallic body part on the back side of the face part, and an elastic intermediate part made of elastic material between the body part and the face part for elastically transmitting force between the body part and the face part.

19 Claims, 5 Drawing Sheets

(56) References Cited

U.S. PATENT DOCUMENTS

| | | | | |
|---|---|---|---|---|
| 4,269,380 | A * | 5/1981 | Shima | H02G 11/003 187/411 |
| 2001/0014996 | A1* | 8/2001 | Ericson | B66B 7/085 24/136 R |
| 2014/0182975 | A1* | 7/2014 | Ikonen | B66B 5/0031 187/251 |
| 2015/0307322 | A1* | 10/2015 | Peacock | B66B 7/064 187/254 |
| 2016/0152443 | A1* | 6/2016 | Mitsui | B66B 7/06 187/254 |

FOREIGN PATENT DOCUMENTS

| | | | |
|---|---|---|---|
| GB | 896468 | | 5/1962 |
| WO | WO 2009/090299 | A1 | 7/2009 |
| WO | WO 2010/000330 | A1 | 1/2010 |

* cited by examiner

ELEVATOR

FIELD OF THE INVENTION

The invention relates to elevators for transporting passengers and/or goods, more particularly to a rope clamping device for engaging to one or more ropes of such an elevator.

BACKGROUND OF THE INVENTION

Elevators according to prior art usually comprise one or more ropings connected to the elevator car. Typically an elevator comprises at least a suspension roping, but many elevators also comprise a so called compensation roping. These ropings may each comprise one or more ropes, which are typically either round in cross-section or belt-shaped.

A rope clamp is a device, which engages at least substantially immovably to the ropes by compressing the ropes between its two clamping members positioned on opposite sides of the rope. There are various different situations where the ropes need to be engaged by a rope clamp. The ropes of an elevator may need to be clamped by a rope clamp, either permanently or temporarily. For example, a rope clamp can be used as a means for fixing the rope ends immovably to a structure, such as to the elevator car with a roping of 1:1 ratio, or to a stationary structure of the building in cases where the roping is connected to the car via diverting wheel(s). In these cases, the rope clamp forms a permanent part of the elevator. A rope clamp can also be used as a tool in a temporary arrangement meant for moving the ropes with an auxiliary hoist. A need for moving the ropes with an auxiliary hoist typically arises, when the safety gear of the car has been triggered and the car needs to be forced to move, most typically upwards, in order to release the safety gear wedged against the guide rails. By clamping to the hoisting ropes with the rope clamp, and subsequently lifting the ropes by lifting the clamp with the hoist such that the car is lifted, the wedging of the safety gear can be released. Furthermore, a rope clamp can also be used to clamp the ropes of a jump-lift elevator. In that case, the rope clamp engages the ropes between a first rope portion and second rope portion. The first rope portion is in use by the elevator, for example for suspending the elevator car, and the second rope portion passes unbroken from the rope clamp to a rope storage. In this arrangement, the length of the first rope portion used by the elevator can be increased by releasing the rope clamp and guiding rope via the rope clamp from the storage to the opposite side of the rope clamp.

Safety being extremely important in elevators, the holding capacity of the rope clamp needs to be dimensioned high. In one example representing a normal case, the rope clamp needs to maintain its grip against a pull of 9.2 kN per rope. A drawback of known solutions is that so as to provide reliable holding capacity, the rope clamp needs to compress the ropes very strongly. A drawback of known solutions is that a strong compression easily damages the rope. Especially, ropes comprising fragile or soft material are likely to damage when clamped with a rope clamp.

BRIEF DESCRIPTION OF THE INVENTION

The object of the invention is, inter alia, to solve previously described drawbacks of known solutions and problems discussed later in the description of the invention. The object of the invention is to introduce a rope clamp for an elevator as well as an elevator arrangement, which can engage to one or more ropes gently yet by a great holding capacity. It is an object, inter alia, to facilitate clamping ropes comprising fragile material. Embodiments are presented, inter alia, which are improved in terms of the evenness of the compression directed to the rope by the rope clamp. Embodiments are presented, inter alia, which facilitate avoiding excessive compression force against the rope, and thereby removing the risk of damaging the rope by excessively forceful clamping.

It is brought forward a new rope clamp for clamping one or more ropes of an elevator. The rope clamp comprises a first clamping member having a first clamping face for being set against one or more ropes to be clamped, and a second clamping member having a second clamping face for being set against one or more ropes to be clamped, wherein said clamping faces define a gap between them for receiving the one or more ropes, the clamping members being relatively movable towards each other such that the gap is narrowed for clamping one or more ropes between the clamping faces thereof. The rope clamp further comprises means for moving the clamping members towards each other such that the gap is narrowed. The first clamping member and/or the second clamping member of the rope clamp comprise(s) a metallic face part forming the clamping face of the clamping member in question, and a metallic body part on the back side of the face part, and an elastic intermediate part made of elastic material between the body part and the face part for elastically transmitting force between the body part and the face part. This structure with layers of different functions and properties facilitates firm but gentle clamping of the one or more ropes. The elastic intermediate part between the metallic parts equalizes the clamping forces to be more even over the gap area. It provides by its ability to yield a slight freedom of relative movement between the metallic body part and the metallic face part. Particularly, the clamping forces are equalized to be more even in case there are manufacturing tolerances, wear of surface or corresponding irregularities in an individual rope, but also in case there are such irregularities between several individual ropes clamped by the clamping members. The metallic face part facilitates even transfer of forces to the surface(s) of the rope(s), especially by controlling the flow of the material of the elastic intermediate part in high pressure during clamping.

In a preferred embodiment the elastic intermediate part is made of elastomer, such as rubber, most preferably neoprene.

In a preferred embodiment the elastic intermediate part is made of material having 65-75 Shore A hardness, most preferably 70 Shore A hardness, such as rubber, most preferably neoprene.

In a preferred embodiment the face part comprises aluminium. Preferably, it is made of aluminium or an aluminium alloy. Thus, the metallic face part is made deformable by its material selection. Thereby, it forms a slightly deformable cover layer for the elastic intermediate part. Aluminium gives the face part ability to bend and/or compress. Thus, the equalizing effect of the clamping forces is further facilitated. This kind of deformability of the metallic face part can be facilitated additionally or alternatively also by making the metallic face part have a shape supporting this behavior, in particular by making the metallic face part sheet-like. The deformability is at strongest when these both are realized simultaneously. An additional advantage of their simulatanous presence is that a strong deformability is realized but with minimal, if any, permanent deformation of the metallic face part.

In a preferred embodiment the metallic face part is sheet-like, in particular in the form of a plate. Then, the wide face of the sheel-like metallic face part forms the clamping face of the clamping member where it belongs to. A sheet-like face part distributes the forces efficiently equally on the rope(s). In particular, this effect is advantageous when the rope is belt-shaped so as to establish a wide clamping contact area.

In a preferred embodiment the elastic intermediate part is sheet-like, in particular in the form of a plate. Then, it is on the back side of the face part its wide side facing towards the face part. Thus, the elastic intermediate part, being obviously fairly thin in thickness when compared to its width, is designed to provide by slight but not excessive yielding a slight freedom of relative movement between the metallic body part and the metallic face part. Also, in this way a wide contact area can be established between them.

In a preferred embodiment said metallic face part of the first clamping member and/or the second clamping member forms the clamping face of the clamping member in question for several ropes. The structure of the clamping member is thus simple. This feature is made feasible especially by the yielding properties provided largely by the elastic intermediate part. The sheet-like structure of the metallic face part is in this case particularly preferable as thus a common face part for several ropes can be simply formed. For making the implementation simple, it is preferable that the ropes are adjacent and extend parallelly on the same plane.

In a preferred embodiment the ropes are belt-like ropes, said clamping face(s) of the first clamping member and/or second clamping member is suitable for being set against the wide side of the one or more ropes to be clamped. The equalization of clamping forces is especially advantageous and important in this kind of configuration, because the area of contact under substantial clamping pressure between the rope and the clamping face can be maximized and at the same time peaks of clamping pressure avoided. Thus, damaging of the rope surface due to peaks of clamping pressure can be avoided, and at the same time also good holding capacity of the engagement can be ensured due to large efficiently engaged contact area.

In a preferred embodiment the metallic face part, the elastic intermediate part and the metallic body part are stacked against each other and together form a three-layered structure. Each of these components can thereby serve a function of its own, whereby the properties of the clamping member are simple to optimize. It is preferable that they are all sheet like and stacked against each other in their thickness direction. Thus, they have a wide contact surface, whereby they support each other and even force distribution between them can be achieved.

In a preferred embodiment the metallic face part, the elastic intermediate part and the metallic body part are fixed to each other. Thereby, they together form a single piece of the clamping member, which is easy to handle and wherein several functions are integrated. Thus, for example the movement for narrowing the gap is easy to control as all these components need not be controlled separately.

In a preferred embodiment the means) for moving the clamping members towards each other are arranged to act on the body part(s) of the first and/or the second clamping member. In particular, the means for moving the clamping members towards each other are arranged to act on the body part(s) by exerting a force on the body part(s) for moving the clamping members towards each other. The body part is simple to design strong, whereby it is easy to design suitable for receiving the tightening force. Thus, no force need to be exerted directly on the other parts by the means for moving the clamping members towards each other. The means for moving the clamping members towards each other preferably comprise one or more screw tighteners, such as bolt-and-nut-pairs or equivalent.

In a preferred embodiment the body part is made of metal harder that the material of the metallic face part, for example the body part is made of steel and the a metallic face part comprises aluminium. Thus, the materials of these components are chosen optimally for their functions described above.

In a preferred embodiment the rope clamp is a rope clamp for fixing said one or more ropes immovably to a structure, which structure is preferably a structure of the elevator car or a stationary part of the building in which the elevator is installed. Then, the rope clamp is provided for being fixed immovably to said structure. For example, the rope clamp comprises fixing means for fixing the rope clamp immovably to said structure. In this way, a reliable, firmly holding and simple rope clamp is achieved, which can gently clamp one or more ropes.

In a preferred embodiment the rope clamp is releasable.

In a preferred embodiment said one or more ropes comprise several ropes, which are spaced apart from each other. Then, preferably the means for moving the clamping members towards each other comprises several bolts, which are spaced apart from each other and the rope clamp is adapted for receiving a rope between pairs of neighboring bolts. Thus, the arrangement is space efficient and an even force distribution for moving the clamping members towards each other can be produced.

In a preferred embodiment, the rope clamp is further provided with a means for limiting the compression exerted on the ropes. So as to achieve a function of this kind the rope clamp preferably at least one metallic blocking member for blocking the clamping members, in particular the body parts thereof from moving relative each other closer towards each other beyond a certain limit distance. Thereby a minimal distance between the body parts can be set. Then in the blocking state, the blocking member is against and between the body parts of the clamping members blocking the body parts from moving relatively towards each other beyond a certain limit distance, thereby limiting the minimal distance between the body parts. Preferably, the clamping members each have a portion free of elastic intermediate part and the metallic face part, in particular a cutout of the elastic intermediate part and the metallic face part at the point of the blocking member in line of said movement occurring during said narrowing of the gap, whereby when the clamping members are moved towards each other, the body parts are finally brought to be simultaneously in contact with the blocking member between them and their further movement towards each other is blocked by the blocking member. The dimensions are preferably such that said limit distance is shorter than thickness of the rope plus the distance between the clamping face of the first clamping member from the body thereof when the first clamping member is in rest state, i.e. not compressing a rope, plus distance of the clamping face of the second clamping part from the body part thereof when the second clamping member is in rest state, i.e. not compressing a rope.

It is also brought forward a new elevator arrangement, comprising an elevator car, and one or more suspension ropes for suspending the elevator car and connected to the elevator car, and a rope clamp arranged to clamp said one or more suspension ropes. The rope clamp is as defined above. In this arrangement said one or more suspension ropes are engaged to gently yet by a great holding capacity.

In a preferred embodiment the rope clamp is arranged to fix said one or more ropes immovably to a structure, which structure is preferably a structure of the elevator car or a stationary part of the building in which the elevator is installed. Then, the clamp provides the function of forming a rope fixing of the elevator. The rope clamp is in this case particularly fixed immovably to said structure.

In a preferred embodiment the arrangement is an arrangement for releasing a safety gear from wedged state. Then, the arrangement preferably comprises a pulling device connected to the rope clamp clamping said one or more suspension ropes for suspending the elevator car, which pulling device is arranged to pull the elevator car upwards by pulling the rope clamp clamping said one or more suspension ropes for suspending the elevator car such that the elevator car rises. The rope clamp is in this case preferably arranged to clamp to a tensioned section of the rope(s).

In a preferred embodiment the ropes are belt-like ropes, said clamping face(s) of the first clamping member and/or second clamping member being set against the wide side of the one or more ropes to be clamped. Thus, great holding capacity and low pressure per unit area of the rope(s) is achieved.

In a preferred embodiment the rope comprises one or more continuous load bearing members extending in longitudinal direction of the rope throughout the length of the rope, which load bearing member(s) is/are made of composite material comprising reinforcing fibers embedded in polymer matrix. The reinforcing fibers are preferably carbon fibers. In this context, the rope clamp is particularly useful as the rope having fragile parts can be clamped gently but firmly without damaging the most fragile parts thereof.

In a preferred embodiment the rope comprises one or more continuous load bearing members extending in longitudinal direction of the rope throughout the length of the rope which load bearing member(s) is/are embedded in elastic coating forming the surface of the rope. In this context, the rope clamp is particularly useful as the rope having vulnerable parts can be clamped gently but firmly without damaging the most fragile parts thereof.

Preferably, the load bearing member(s) is/are parallel with the longitudinal direction of the rope. Thereby, it/they provide excellent longitudinal stiffness for the rope. The reinforcing fibers are also preferably parallel with the longitudinal direction of the rope, which facilitates further the longitudinal stiffness of the rope.

Preferably, the rope is such that reinforcing fibers are distributed in the matrix substantially evenly. Also preferably, all the individual reinforcing fibers of the load bearing member are bound to each other by the matrix.

The elevator as describe anywhere above is preferably, but not necessarily, installed inside a building. The car is preferably arranged to move vertically and serve two or more landings. The car preferably is arranged to respond to calls from landing(s) and/or destination commands from inside the car so as to serve persons on the landing(s) and/or inside the elevator car. Preferably, the car has an interior space suitable for receiving a passenger or passengers.

BRIEF DESCRIPTION OF THE DRAWINGS

In the following, the present invention will be described in more detail by way of example and with reference to the attached drawings, in which.

DETAILED DESCRIPTION

Figure 1:
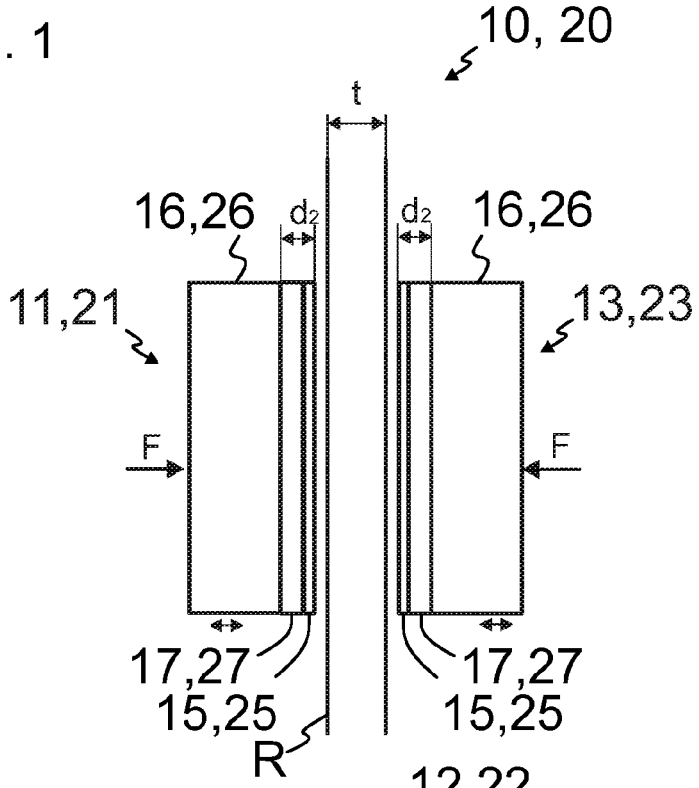
FIG. 1 illustrates a rope clamp according to a preferred embodiment.

FIG. 1 illustrates a preferred embodiment of a rope clamp 10,20 for clamping one or more ropes R, such as belt-like ropes. The rope clamp 10, 20 can be used for clamping only one rope R or several ropes R simultaneously. The rope clamp 10, 20 comprises a first clamping member 11, 21 having a first clamping face 12,22 for being set against the lateral side face of one or more ropes R to be clamped. The rope clamp 10, 20 further comprises a second clamping member 13,23 having a second clamping face 14,24 for being set against one or more ropes R to be clamped. Said clamping faces 12,14;22,24 define a gap between them for receiving said one or more ropes R, the clamping members 11,21 being relatively movable towards each other, such that the gap is narrowed, for clamping one or more ropes R between the clamping faces thereof. The rope clamp 10, 20 further comprises means for moving the clamping members 11, 21 towards each other such that the gap is narrowed. At least one, however preferably both (as illustrated) of the first and the second clamping member 11,21 comprise(s) a metallic face part 15,25 forming the clamping face 14,24 of the clamping member in question, and a metallic body part 16,26 on the back side of the face part 15,25 (i.e. on the side opposite the gap), as well as an elastic intermediate part 17,27 made of elastic material also on the back side of the face part 15,25 placed between the body part 16, 26 and the face part 15, 25 for elastically transmitting force between the body part 16, 26 and the face part 15, 25. This structure with layers of different functions and properties facilitates firm but gentle clamping of the one or more ropes R. The elastic intermediate part 17, 27 between the metallic parts 15,25 and 16,26 equalizes the clamping forces to be more even over the gap area. Particularly, the clamping forces are equalized to be more even in case there are manufacturing tolerances, wear of surface or corresponding irregularities in an individual rope R, but also in case there are such irregularities between several individual ropes. The metallic face part 15, 25 facilitates even transfer of forces to the surface(s) of the rope(s) R especially by controlling the flow of the material of the elastic intermediate part 17, 27 in high pressure during clamping. Without the metallic face part 15, 25, the material of the elastic intermediate part 17, 27 is likely to flow in an uncontrolled manner, and it is difficult to ensure even distribution of forces on the rope(s) R. The metallic face part 15, 25 is preferably made deformable. The deformability of the metallic face part 15, 25 is facilitated by making it sheet-like, as illustrated later in FIGS. 1 to 6. Then, the wide face of the sheel-like metallic face part 15, 25 forms the clamping face 12,22 of the clamping member where it belongs to. The equalizing effect is especially efficient when the metallic face part 15,25 comprises aluminium, e.g. is made of aluminium or an aluminium alloy. The metallic face part 15, 25 can, thanks to its thin shape and/or relatively resilient metal material slightly deform under compression, such as bend and/or compress. Thereby, it forms a slightly deformable cover layer for the elastic intermediate part 17, 27.

In the preferred embodiments, the ropes R are belt-like ropes, and thereby having a width w greater than thickness t in transverse direction of the rope R. In particular, the rope R has two opposite sides (also referred to as wide sides) extending in width direction of the rope R, each having a width w that is substantially greater than the thickness t of the rope R. Each of said clamping faces 12,22;14,24 of the first and second clamping members 11,21;13,23 is suitable for being set against the wide side of the one or more ropes R to be clamped. The equalization of clamping forces is especially advantageous and important in this kind of configuration, because the area of contact under substantial clamping pressure between the rope R and the clamping face can be maximized and at the same time peaks of clamping pressure avoided. Thus, damaging of the rope surface due to peaks of clamping pressure can be avoided, and at the same time also good holding capacity of the engagement can be ensured due to large efficiently engaged contact area.

The elastic intermediate part 17,27 is preferably made of elastomer, such as rubber, most preferably neoprene. This material endures well the intended use, and provides optimal elastic properties. The elastic intermediate part 17,27 is particularly made of material having 65-75 Shore A hardness, most preferably 70 Shore A hardness, such as rubber, most preferably neoprene.

Figure 2:
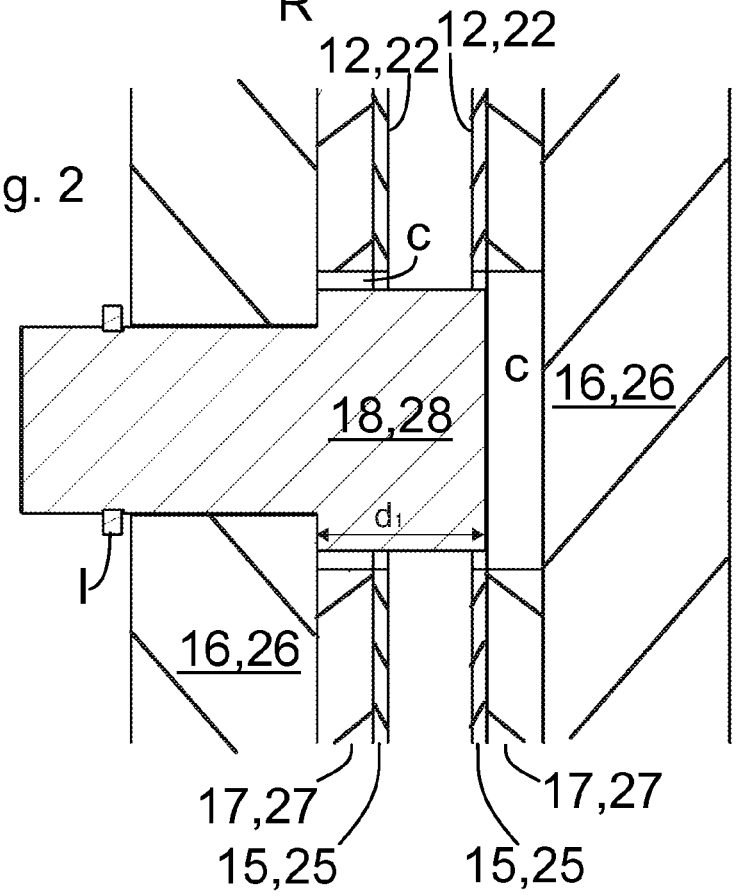
FIG. 2 illustrates further preferred details for the rope clamp of FIG. 1.
Figure 3:
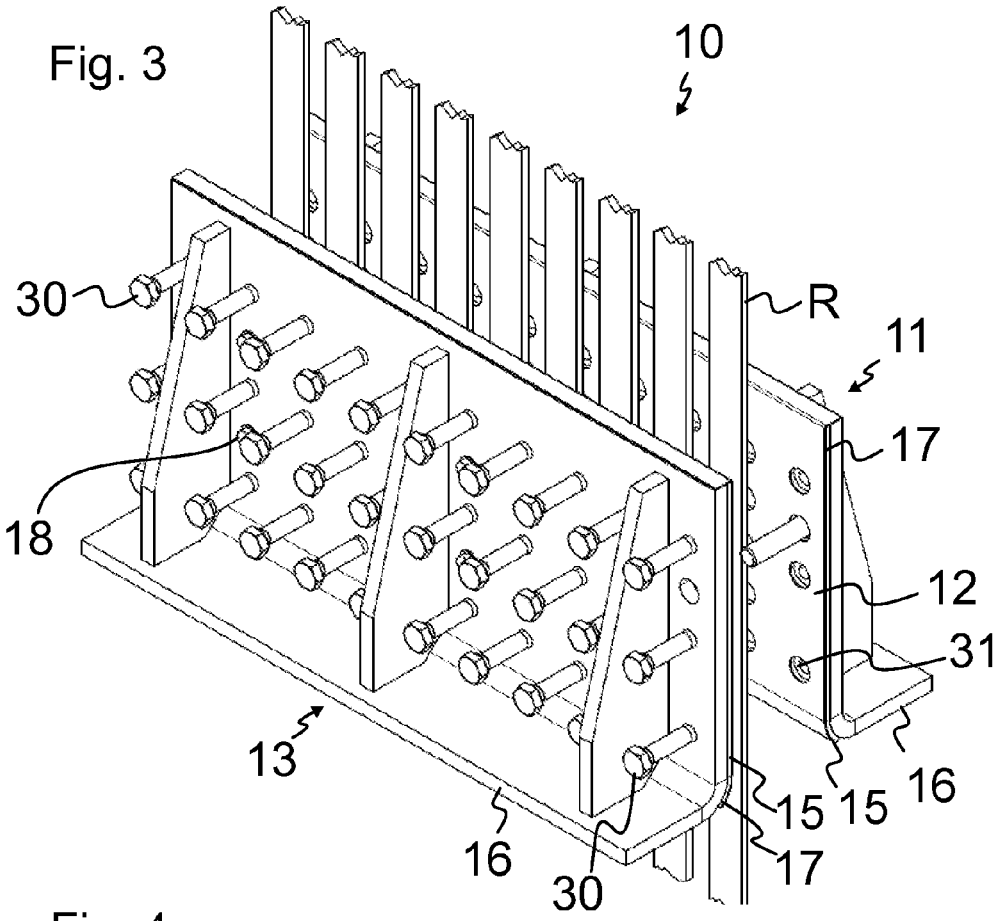
FIG. 3 illustrates a rope clamp according to a first more detailed preferred embodiment.
Figure 4:
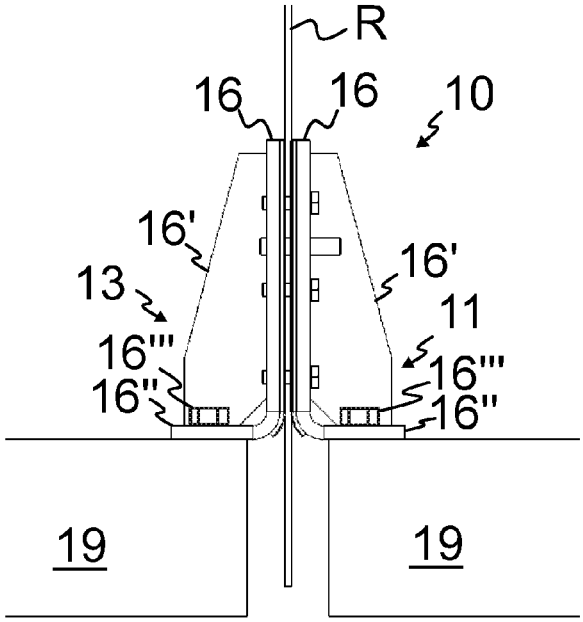
FIG. 4 illustrates the rope clamp of FIG. 3 in clamping state.
Figure 5:
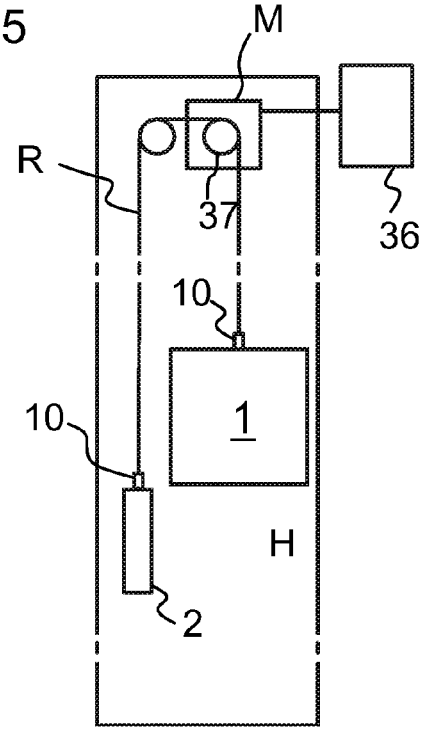
FIG. 5 illustrates an elevator arrangement wherein the rope clamp of FIG. 3 is implemented.
Figure 6:
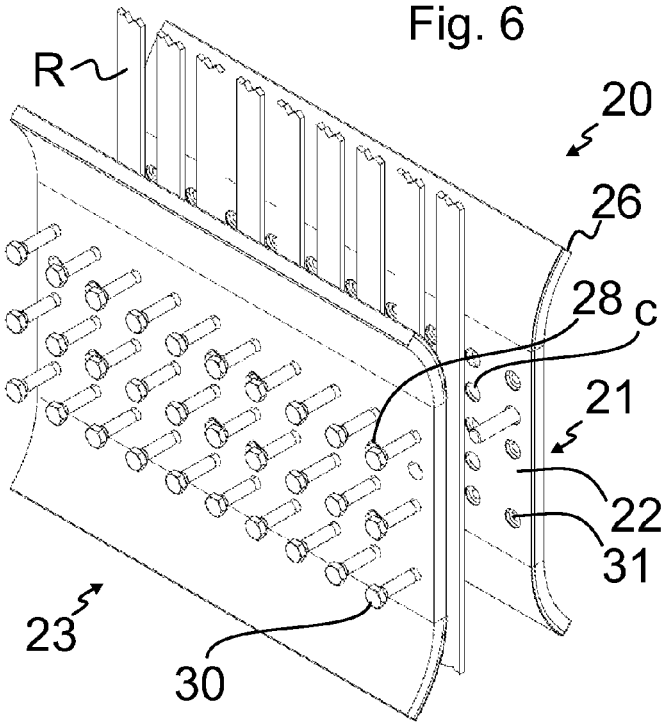
FIG. 6 illustrates a rope clamp according to a second more detailed preferred embodiment.
Figure 7:
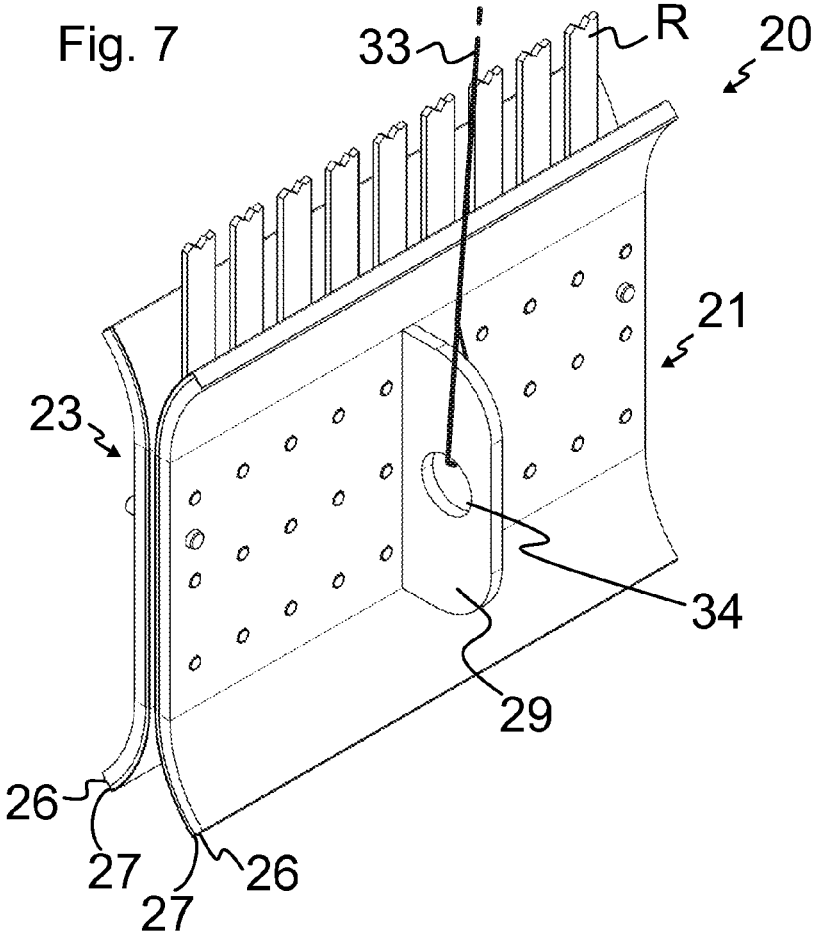
FIG. 7 illustrates the rope clamp of FIG. 6 in clamping state.
Figure 8:
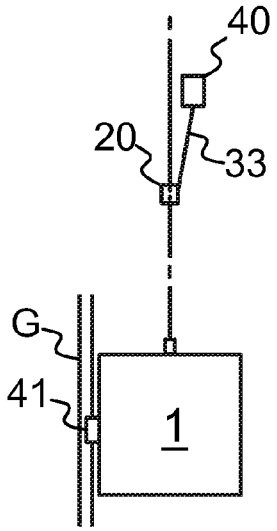
FIG. 8 illustrates an elevator arrangement wherein the rope clamp of FIG. 6 is implemented.

FIGS. 2 to 8 illustrate further preferred details for the rope clamp 10, 20, FIGS. 3 to 5 illustrating an embodiment wherein the rope clamp 10 is a rope clamp for fixing ropes R immovably to a structure 19 and FIGS. 6 to 8 illustrating an embodiment wherein the rope clamp 20 is a rope clamp of an arrangement for clamping and pulling the ropes R of an elevator. In both embodiments, said metallic face part 15,25 of the first clamping member 11,21 and the second clamping member 13,23 forms the clamping face 14,24 of the clamping member in question for several ropes R, which are adjacent and extend parallelly on the same plane. FIGS. 4 and 7 illustrate the rope clamp 10,20 in such a clamping state. The ropes Rare belt-like ropes, and said clamping face(s) 12,22;14,24 of the first clamping member and the second clamping member 11,21;13,23 are in the clamping state set against the wide sides of the ropes R to be clamped.

The metallic face part 15,25, the elastic intermediate part and the metallic body part 16,26 are in these preferred embodiments all sheet like and stacked in their thickness direction against each other, such that they together form a three-layered composite structure.

The means 30,31 for moving the clamping members towards each other are in the form of several screw tighteners, in particular several bolt and nut-pairs. The head of the bolts 30 and the nuts 31 are on opposite sides of the two body parts 16, 26, and the screw pin extends through the body parts 16, 26, whereby tightening of the screw tightener pulls the body parts 16, 26 towards each other. Said one or more ropes R preferably comprise several ropes, which are spaced apart from each other, and the means 30,31 for moving the clamping members towards each other comprises several bolts 30, which are spaced apart from each other and the rope clamp 10,20 is adapted for receiving a rope R between pairs of neighboring bolts 30. Thus, the arrangement is space efficient and an even force distribution for moving the clamping members towards each other can be produced.

The means for moving the clamping members towards each other are arranged to act on the body parts 16, 26 of the first and the second clamping member 11, 21. In particular, the means for moving the clamping members towards each other are arranged to act on each of the body parts 16, 26 by exerting a force on each of the body parts 16, 26 for moving the clamping members 11, 21 towards each other. The body part 16, 26 is simple to design strong, whereby it is easy to design suitable for receiving the tightening force. Thus, no force need to be exerted directly on the other parts 16,26 and 17,27 by the means for moving the clamping members towards each other. The body part further transmits the tightening force to the elastic intermediate part 17,27, which elastically transmits the force further to the face part 15, 25. So as to make the body part 16, 26 simple, strong and suitable for receiving the tightening force it is preferably of hard and strong metal, such as steel. The body part 16, 26 is particularly preferably made of metal harder that the metallic face part 15, 25, for example the body part 16, 26 is made of steel and the metallic face part 15, 25 comprises aluminum. Thus, the materials of these components are chosen optimally for their functions.

FIGS. 4 to 5 illustrates the rope clamp 10 in a state where it fixes ropes R of an elevator immovably to a structure 19, which structure is a structure of the elevator car 1. The metallic body parts 16 of the rope clamp 10 are fixed immovably to a structure 19 with fixing means 15', which are in this case in the form of a screw tightener, in particular a bolt, passing through a hole formed in the rope clamp 10. The rope clamp 10 further comprises a stiffener 15' for stiffening each body part 16. Each body part 16 comprises a portion 15" forming a fixing face (facing down in FIG. 3) which fixing face is at a right angle relative to the clamping face 14 and set against the face of the structure 19 extending at a right angle relative to the clamping face 14. The ropes R are thus fixed to a face of the structure 19 extending at a right angle relative to the longitudinal direction of the ropes R.

The elevator can, as illustrated in FIG. 7, is of the type having a rotatable traction member 37 is preferably in the form of a traction wheel 37, around which the ropes R pass. The rotatable traction member 37 is rotatable by a motor M under control of an elevator control system 36. Thereby transport of the elevator car 1 upwards or downwards is arranged to be carried out in an automatized manner.

FIGS. 7 to 8 illustrate the rope clamp 20 in a state where it clamps the ropes R of an elevator, and is connected to a pulling device 40 with a means 33 for transmitting force between the pulling device 40 and the rope clamp 20, which means 33 is in this case a rope, but could alternatively be a chain or equivalent. Said one or more ropes are suspension ropes suspending the elevator car 1. The rope clamp 20 clamps a tensioned section of each of the ropes R. In this case, the rope clamp 20 is implemented as a part of an arrangement for releasing a safety gear 41 from wedged state. The safety gear 41 is of the type that can engage a guide rail G of the elevator by downwards directed movement. This kind of safety gear 41 being a well known elevator component, it is not further described here. The elevator car 1 is arranged to be pulled upwards by the pulling device 40 via the aforementioned means 33 and the rope clamp 20 clamping the suspension rope(s). Thus, the elevator car 1 can be lifted so as to undo the wedging of the safety gear 41 to guide rail G of the elevator car 1. The pulling device 40 can be in the form of a hoist, such as a Tirak hoist for instance. For the purpose of the aforementioned connection between the pulling device and the rope clamp 20, the rope clamp comprises a connecting means 29, which is in this case comprise a hole 34 formed in the rope clamp 20 for receiving the means 33 for transmitting force between the pulling device and the rope clamp 20, i.e. in this case rope 33. The rope 33 is arranged to pass via the hole 34.

The rope clamp 10, 20 is preferably further provided with a means for limiting the compression exerted on the ropes. So as to achieve a function of this kind the rope clamp 10,20 comprises as illustrated in FIG. 2 the at least one metallic blocking member 18,28 for blocking the clamping members 11,21, in particular the body parts 16, 26 thereof from moving relative each other closer towards each other beyond a certain limit distance d1. Thereby a minimal distance between the body parts 16, 26 can be set. In the blocking state, the blocking member 18,28 is against and between the body parts 15,2516, 26 of the clamping members 11,13;21, 23 blocking the body parts 16, 26 from moving relatively towards each other beyond a certain limit distance d1, thereby limiting the minimal distance between the body parts 16, 26. The clamping members 11,13;21,23 each have a portion free of elastic intermediate part 17,27 and the metallic face part 15,25, in particular a cutout c of the elastic intermediate part 17,27 and the metallic face part 15,25 at the point of the blocking member 18,28 in line of said movement occurring during said narrowing of the gap, whereby when the clamping members are moved towards each other, the body parts 16, 26 are finally simultaneously in contact with the blocking member 18,28 between them and their further movement towards each other is blocked by the blocking member 18,28. The blocking member 18,28 comprises a portion between the body parts 16, 26 and having a thickness (as measured in the direction of movement occurring during said narrowing of the gap) equal to said limit distance d1. The blocking member 18,28 is the embodiment illustrated in FIG. 2 in the form of a pin extending through a hole formed in one of the body parts 16, 26 and comprises a flange extending between the body parts 16, 26 and having a thickness equal to said limit distance d1. The pin is in the preferred embodiment locked in its place with a locking pin 1. The dimensions are preferably such that said limit distance d1 is shorter than thickness t of the rope plus distance d2, which is the distance between the clamping face of the first clamping member 11,21 from the body part 16, 26 thereof when the first clamping member 11,21 is in rest state, i.e. not compressing a rope, plus distance of the clamping face of the second clamping part 13,23 from the body part 16, 26 thereof when the second clamping member 11,21 is in rest state, i.e. not compressing a rope.

Said one or more ropes R preferably comprise several ropes, which are spaced apart from each other, and the rope clamp 10,20 comprises several blocking members 18,28, which are spaced apart from each other and the rope clamp 10,20 is adapted for receiving a rope R between each pair of neighboring blocking members 18,28.

Figure 9:
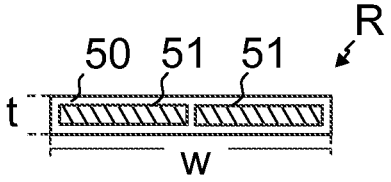
FIGS. 9 and 10 illustrate further preferable details for the rope(s) to be clamped by the rope clamp.

FIG. 9 illustrates the cross section of a preferred structure for an individual rope R. The rope R is in the form of a belt, and thereby has a width w substantially larger than the thickness t thereof. This makes it well suitable for elevator use as bending of the rope is necessary in most elevators. The number of two load bearing members 51 comprised in the rope R can alternatively be also greater or smaller than what is shown in FIG. 9. The load bearing member(s) 51 is/are parallel with the longitudinal direction of the rope R, whereby they provide excellent longitudinal stiffness for the rope R. So as to give a turning radius well suitable for elevator use, it is preferable that the width/thickness ratio of the rope is substantial, in particular more than 2, preferably more than 4 as illustrated. Thus, reasonable bending radius can be achieved for the rope when it contains substantially material of high bending rigidity, such as fiber reinforced composite material. The rope R comprises continuous load bearing members 51 extending in longitudinal direction of the rope R throughout the length of the rope R. The load bearing members are embedded in an elastic coating 50 forming the surface of the rope R. The coating is preferably made of elastomer, such as polyurethane. The elastic coating 50 provides the rope R good wear resistance, protection, and isolates the load bearing members 51 from each other. The elastic coating 50 also provides the rope high friction, for instance for frictional traction contact with a rotatable drive member 37 as illustrated in FIG. 5.

In combination of a rope provided with an elastic coating 50, the aforementioned means for limiting the compression exerted on the ropes R in clamping. Thus, the rope R can be clamped gently but firmly without damaging the elastic coating 50. For the same reason, with this kind of rope R it is important to equalize the clamping forces to be as even as possible over the gap area. Thereby, the function provided by the elastic intermediate part 17,27 is advantageous in combination with this kind of rope R.

Figure 10:
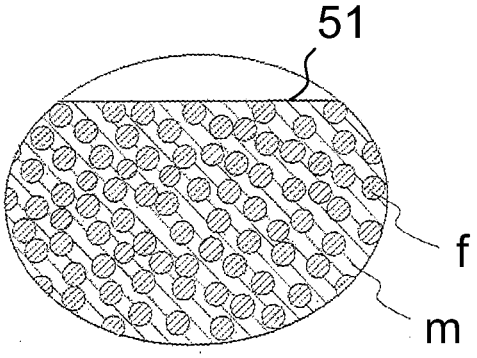

Preferably, each of said load bearing members 51 is made of composite material comprising reinforcing fibers f embedded in polymer matrix m. FIG. 10 illustrates inside the circle a partial and enlarged cross-section of the load bearing member 51 of the rope R. Thus, the rope R has good longitudinal stiffness and low weight, which are among preferred properties for an elevator. The composite material, however, is relatively fragile and cannot withstand extremely high lateral compression. The reinforcing fibers are most preferably carbon fibers, which are most advantageous in terms of longitudinal stiffness as well as weight. In combination of composite material of the load bearing member 51, especially when the fibers are carbon fibers, the aforementioned means for limiting the compression exerted on the ropes R in clamping. Thus, the rope R can be clamped gently but firmly without damaging the most fragile parts thereof. For the same reason, with this kind of rope R it is important to equalize the clamping forces to be as even as possible over the gap area. Thereby, the function provided by the elastic intermediate part 17,27 is advantageous in combination with this kind of rope R.

To reduce buckling of fibers and to facilitate a small bending radius of the rope, among other things, it is therefore preferred that the polymer matrix is hard, and in particular non-elastomeric. The most preferred materials are epoxy resin, polyester, phenolic plastic or vinyl ester. The matrix of the load bearing member 51 is preferably such that the module of elasticity E of the polymer matrix is over 2 GPa, most preferably over 2.5 GPa, yet more preferably in the range 2.5-10 GPa, most preferably of all in the range 2.5-3.5 GPa. One advantage, among others, is a longer service life.

The composite material is preferably such that the individual reinforcing fibers are parallel with the length direction of the rope. Thus, they provide excellent longitudinal stiffness for the rope. The individual reinforcing fibers are preferably distributed in the matrix substantially evenly, such that substantially all the individual reinforcing fibers of the load bearing member are bound to each other by the matrix. The rope R is preferably in accordance with any one of the composite ropes disclosed in international patent application WO2009090299A1.

The clamping face may be smooth, but alternatively, it can have an uneven surface pattern, such as so called rice pattern, so as to enhance the holding ability of the clamp 10,20. The rope clamp 10,20 is preferably dimensioned to form a long contact with the ropes R. In particular, the clamping members 11,21;13,23 are preferably adapted to form with the clamping faces 14,24;12,22 at least 10 cm long contact between each of the ropes R as measured in longitudinal direction of the rope R.

In the Figures, implementation with only belt-like ropes are presented, but the device can be adapted to be used for ropes having different belt-like shapes of cross-section but also for ropes having different cross-section than bell-shaped cross-section, such as for ropes having round cross-section.

The rope clamp 10, 20 is preferably releasable. Thus, the clamping can be released when needed. The rope clamp 10 is also suitable for being used in a jump-lift arrangement. The arrangement can in that case be otherwise similar to that of FIG. 5, but additionally a rope portion passes unbroken from the rope clamp 10 to a rope storage (not illustrated). In this way, the length of the rope portion of the rope R suspending the car 1 can be increased by releasing the clamp 10 and guiding rope R via the rope clamp 10 from one side of the rope clamp 10 to the opposite side thereof.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A rope clamp for clamping one or more ropes comprising:

a first clamping member having a first clamping face for being set against one or more ropes to be clamped;

a second clamping member having a second clamping face for being set against one or more ropes to be clamped;

said clamping faces defining between them a gap for receiving one or more ropes, the clamping members being relatively movable towards each other such that the gap is narrowed for clamping one or more ropes between the clamping faces thereof; and a device configured to move the clamping members towards each other such that the gap is narrowed, wherein at least one of the first clamping member and the second clamping member comprises:

a metallic face part forming the clamping face of the clamping member in question;

a metallic body part on a back side of the face part; and an elastic intermediate part made of elastic material between the body part and the face part for elastically transmitting force between the body part and the face part, wherein the one or more ropes are ropes in the form of a belt, and said clamping face of at least one of the first clamping member and second clamping member is configured for being set against a wide side of the one or more ropes to be clamped.

2. The rope clamp according to claim 1, wherein the elastic intermediate part is made of elastomer.

3. The rope clamp according to claim 2, wherein the elastomer is neoprene.

4. The rope clamp according to claim 1, wherein the elastic intermediate part is made of material having 65-75 Shore A hardness.

5. The rope clamp according to claim 4, wherein the Shore A hardness is 70.

6. The rope clamp according to claim 1, wherein the face part comprises aluminum.

7. The rope clamp according to claim 1, wherein the metallic face part is in the form of a sheet.

8. The rope clamp according to claim 1, wherein the elastic intermediate part is in the form of a sheet.

9. The rope clamp according to claim 1, wherein said metallic face part of at least one of the first clamping member and the second clamping member forms the clamping face of the clamping member for the one or more ropes.

10. The rope clamp according to claim 1, wherein the metallic face part, the elastic intermediate part and the metallic body part are stacked against each other, and together form a three-layered structure.

11. The rope clamp according to claim 1, wherein the device configured to move the clamping members towards each other is arranged to act on the body part of at least one of the first and the second clamping member.

12. The rope clamp according to claim 1, wherein the body part is made of metal harder than the material of the metallic face part.

13. The rope clamp according to claim 12, wherein the body part is made of steel and the metallic face part is made of aluminium.

14. The rope clamp according to claim 1, the rope clamp comprises one or more metallic blocking members for blocking the clamping members from moving towards each other beyond a certain limit distance.

15. An elevator arrangement, comprising:

an elevator car; and one or more suspension ropes for suspending the elevator car, wherein said one or more suspension ropes are connected to the elevator car, and a rope clamp is arranged to clamp said one or more suspension ropes, and the rope clamp is as defined in claim 1.

16. The elevator arrangement according to claim 15, wherein each of said one or more ropes comprises one or more continuous load bearing members extending in a longitudinal direction of the rope throughout the length of the rope, the one or more load bearing members being made of composite material comprising reinforcing fibers embedded in polymer matrix.

17. The elevator arrangement according to claim 15, wherein the rope comprises one or more continuous load bearing members extending in a longitudinal direction of the one or more ropes throughout the length of the rope, the one or more load bearing members being embedded in elastic coating forming a surface of the one or more ropes.

18. The elevator arrangement according to claim 15, wherein the rope clamp is arranged to fix said one or more ropes immovably to a structure of the elevator car or a stationary part of the building in which the elevator arrangement is installed.

19. The elevator arrangement according to claim 15, wherein the arrangement is an arrangement for releasing a safety gear from a wedged state, comprising a pulling device connected to the rope clamp clamping said one or more suspension ropes for suspending the elevator car, and arranged to pull the elevator car upwards by pulling the rope clamp clamping said one or more suspension ropes for suspending the elevator car such that the elevator car rises.

* * * * *